US007328555B2

(12) United States Patent
Levy

(10) Patent No.: US 7,328,555 B2
(45) Date of Patent: Feb. 12, 2008

(54) PLANT AND DEVICE FOR THE CONTINUOUS PACKING OF FOOD PRODUCTS IN MODIFIED ATMOSPHERE

(75) Inventor: Roger S. Levy, Melide TI (CH)

(73) Assignee: Ilapak Macchine Automatiche S.A., Lugano (CH)

( * ) Notice: Subject to any disclaimer, the term of this patent is extended or adjusted under 35 U.S.C. 154(b) by 0 days.

(21) Appl. No.: 10/516,531

(22) PCT Filed: Nov. 17, 2003

(86) PCT No.: PCT/EP03/12838

§ 371 (c)(1),
(2), (4) Date: Dec. 2, 2004

(87) PCT Pub. No.: WO2004/045951

PCT Pub. Date: Jun. 3, 2004

(65) Prior Publication Data

US 2005/0229549 A1 Oct. 20, 2005

(30) Foreign Application Priority Data

Nov. 19, 2002 (IT) ..... MI02A2461
Jan. 10, 2003 (IT) ..... MI03A0033

(51) Int. Cl.
*B65B 31/00* (2006.01)

(52) U.S. Cl. ..... 53/510; 53/79; 53/432; 53/514; 53/550

(58) Field of Classification Search ..... 53/111 R, 53/510, 511, 514, 516, 517, 520, 550, 114, 53/432, 529; 198/463.3; 141/61, 66
See application file for complete search history.

(56) References Cited

U.S. PATENT DOCUMENTS

| | | | | | |
|---|---|---|---|---|---|
| 3,545,175 | A | | 12/1970 | Lillund | 53/386 |
| 3,659,393 | A | | 5/1972 | Richter | 53/22 |
| 4,170,863 | A | * | 10/1979 | Schwanz | 53/511 |
| 4,640,081 | A | * | 2/1987 | Kawaguchi et al. | 53/510 |
| 5,027,588 | A | * | 7/1991 | Ikeda et al. | 53/511 |
| 5,109,654 | A | * | 5/1992 | Suga | 53/511 |
| 5,247,746 | A | * | 9/1993 | Johnson et al. | 53/432 |
| 5,311,726 | A | * | 5/1994 | Rauscher et al. | 53/511 |
| 5,371,998 | A | * | 12/1994 | Johnson et al. | 53/432 |
| 5,473,867 | A | * | 12/1995 | Suga | 53/511 |
| 5,752,369 | A | * | 5/1998 | Suga | 53/511 |

FOREIGN PATENT DOCUMENTS

| | | | |
|---|---|---|---|
| EP | 0368116 | | 5/1990 |
| EP | 1279600 | | 1/2003 |
| FR | 1337932 | | 9/1963 |
| FR | 2815013 | | 4/2002 |
| GB | 2005980 | | 5/1979 |
| GB | 1568220 | * | 5/1980 |

* cited by examiner

*Primary Examiner*—Thanh Truong
(74) *Attorney, Agent, or Firm*—Jacobson Holman PLLC

(57) ABSTRACT

A plant (10) for the continuous packing of food products in modified atmosphere (11), comprises a machine (12) for continuous packing of food products in modified atmosphere and conveyor (13) for the continuous sequential feeding of food products to the machine. A device (21) is present at the entrance of the machine (12) that temporarily submits a product fed by the conveyor (13) to vacuum and to a modified atmosphere before being packed in modified atmosphere in the machine.

16 Claims, 2 Drawing Sheets

PLANT AND DEVICE FOR THE CONTINUOUS PACKING OF FOOD PRODUCTS IN MODIFIED ATMOSPHERE

This is a nationalization of PCT/EP03/012838 filed Nov. 17, 2003 and published in English.

The present invention herein refers to an innovative plant for the continuous packing of food products in modified atmosphere. The invention also refers to a device for submitting the products to vacuum and to a modified atmosphere before packing.

In the packing technique of perishable products, vacuum packing and packing in modified atmosphere are well known. In the first case, the complete removal of air from inside the pack ensures long life of the product. On the other hand, it is well known that the appearance of the food packed, which is considerably squashed by the sides of the vacuum packet, is not at all appealing.

In the case of packing in modified atmosphere, the air inside the pack is replaced with suitable inert gases. As the sides of the pack must not closely adhere to the product, as is the case of the vacuum pack, the appearance of the packed product remains basically natural and is therefore more appealing to purchase. For many food products packing in modified atmosphere is therefore preferred. In particular, packing in modified atmosphere is preferred for bakery products, which by their nature do not support the compression of vacuum packing very well and for which the appearance is particularly important when purchasing.

A first type of plant for making packs in modified atmosphere comprises a packing chamber which is sealed after the product (or a series of products) to be packed is placed inside, so that the chamber can be filled with gas and a pack is formed and sealed around the product incorporating said gas. Such machines offer a reduced productive speed because the packing is made discontinuously, having to interrupt the feeding of new products for the whole time needed to carry out a complete packing cycle of the products put into the chamber.

However, such machines are often believed to be preferable for packing "spongy" food products that retain air inside them. In fact, the chamber can be brought to vacuum before the gas is inserted, so as to remove the air that otherwise would remain trapped in the product and would reduce the preservation life. By spongy food products we intend here food products that are permeable to gases and that have a relatively porous mass that can withhold air or other gases inside. Examples of such products are bakery products such as bread, cakes, pizzas and similar products.

Should the productive speed be preferred to the life of the product, continuous machines can be used, in which a conveyor belt sequentially and continuously feeds the products to be packed. The products enter a tunnel packing area where a continuous plastic film strip is folded and sealed in a tubular shape to surround the products in transit from the side while jets of gas are put into the tube. Transversal sealing heads then close segments of the tube to isolate each product. Machines made in this manner can continuously reach very high operative speeds. On the other hand, because of the continuity of the passage of the products in the machine, it is not possible to make a packing area that seals off, which is capable of applying vacuum before the gas is inserted. On the contrary, the packing area, always open towards the outside at the two ends, must be kept in overpressure with the gas to prevent other air from entering which would remain inevitably trapped in the packs.

The operative speed is therefore to the detriment of the preservation life of the packed product, a life that is rather reduced (even more than 50%) compared to what can be obtained with discontinuous machines fitted with packing chamber.

The main aim of the present invention is to avoid the inconveniences mentioned above by providing a plant for packing in modified atmosphere with continuous operation through which a preservation life that is comparable to the much slower discontinuous machines is obtained.

In view of this aim, the intention is to produce, according to the invention, a plant for the continuous packing of food products in modified atmosphere, comprising a machine for continuous packing in modified atmosphere of food products and a conveyor for continuous sequential feeding of food products to the machine, characterized in that at the entrance of the machine means are present that temporarily submit a product fed by the conveyor to vacuum before it is packed in modified atmosphere in the machine. Again according to the principles of the invention it was planned to make a device for temporarily submitting food products that flow sequentially on a continuous conveyor in sequence to vacuum and to a modified atmosphere, comprising at least a bell connected to means for sucking air from inside it and to means for the input of modified atmosphere into it, the bell being held by movement means for its synchronous movement along a transport section of the conveyor for enclosing in said section a product under it and submitting it to said vacuum and to said modified atmosphere.

To make the explanation of the innovative principles of the present invention clearer as well as its advantages compared to the known technique, a description of a possible example of embodiment applying such principles follows, with the help of enclosed drawings. In the drawings.

Figure 1:
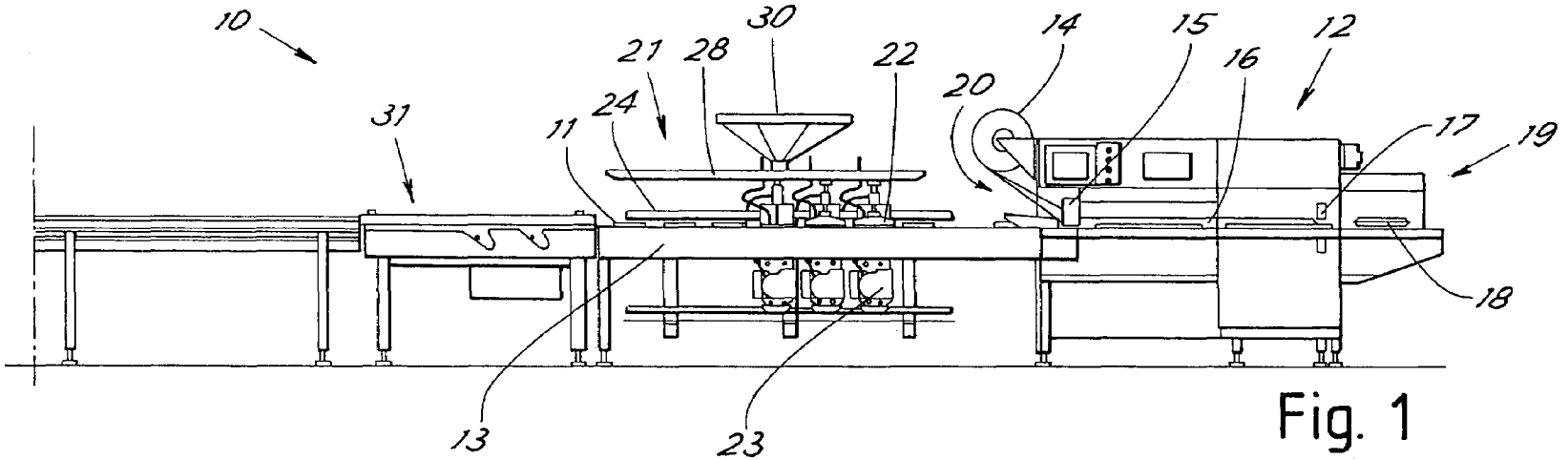
FIG. 1 represents a side elevation of a schematic view of a plant according to the invention.

With reference to the Figures, FIG. 1 shows a plant, indicated generically with 10, for the continuous packing of spongy food products in modified atmosphere. For example, said products (indicated generically with 11 in the Figures) can be bakery products such as cakes, pizzas or similar products.

Plant 10 comprises a machine 12 for continuous packing in modified atmosphere of food products and a conveyor 13 that feeds the products to the machine continuously and sequentially.

The continuous packing machine 12 is a type that in itself is known and therefore will not be shown here or described in detail, as an expert technician can easily imagine it. For example, the machine comprises advantageously a roll 14 of plastic film for making the packs. The film is unwound at the entry 20 of the packing machine to obtain, thanks to known guides and suitable welders 15, a tubular shape 16 inside which the products that transit in the machine are enclosed. The machine also comprises means (not shown) for sending suitable preservation gas into the tube formed by the film. Once the gas has been sent into the tube, transversal sealing means 17 close the packs (indicated generically with 18) that then leave the machine in 19. Means 21 are present at the entrance of the machine 12 which form a device for temporarily submitting the products 11 fed continuously by conveyor 13 to vacuum before being packed in a modified atmosphere. It has been surprising to find that it is not necessary for the product to be held in vacuum or in modified atmosphere until the packing is completed (as for example happens in the discontinuous machines already mentioned). It has been found in fact that the "emptying" of the air inside the product and its replacement with modified atmosphere is maintained for some time even bringing the product into contact with the outside atmosphere at normal pressure. To further reduce the entrance of air in the product until the modified atmosphere enters the packing machine, means 21 also make a device, which after the vacuum sends in modified atmosphere for "filling" the product.

It has been found that all this enables the product to be transferred to the area with gas in overpressure present inside the continuous packing machine.

Advantageously, the means that temporarily submit a product to vacuum and to modified atmosphere before entering the packing area of the machine, comprise at least a bell 22 connected to means 23 for the suction of air from inside it and the following input of modified atmosphere.

The bell 22 is supported by motorized movement means 24 for its synchronous movement along a transport section 25 of the conveyor that is near the entrance of the packing machine. The movement means enable a product to be enclosed under the bell in said section 25 so that it can be submitted to vacuum, the bell acting as a seal on a transport surface of the conveyor. The suction means are chosen so as to have sufficient power to extract a sufficient quantity of air and in the short time required for the particular type of product that needs to be packed. After having obtained the required vacuum, the means 23 input the gas chosen to create the modified atmosphere. The product under the bell thus absorbs the gas.

Advantageously, several bells are foreseen to act simultaneously on several products positioned sequentially along said transport section, so as to have greater suction time available.

The number of bells and their reciprocal distance will be such that the pitch of the bells along section 25 is equal to the pitch of the products in said section, so that each product is met by a bell from the beginning of the section 25 up to the end of said section. For simplicity, in the drawings only some bells are shown.

Upstream of section 25 known means 31 can be provided for correct spacing and the correct phasing of products in relation to the carousel of bells.

Figure 2:
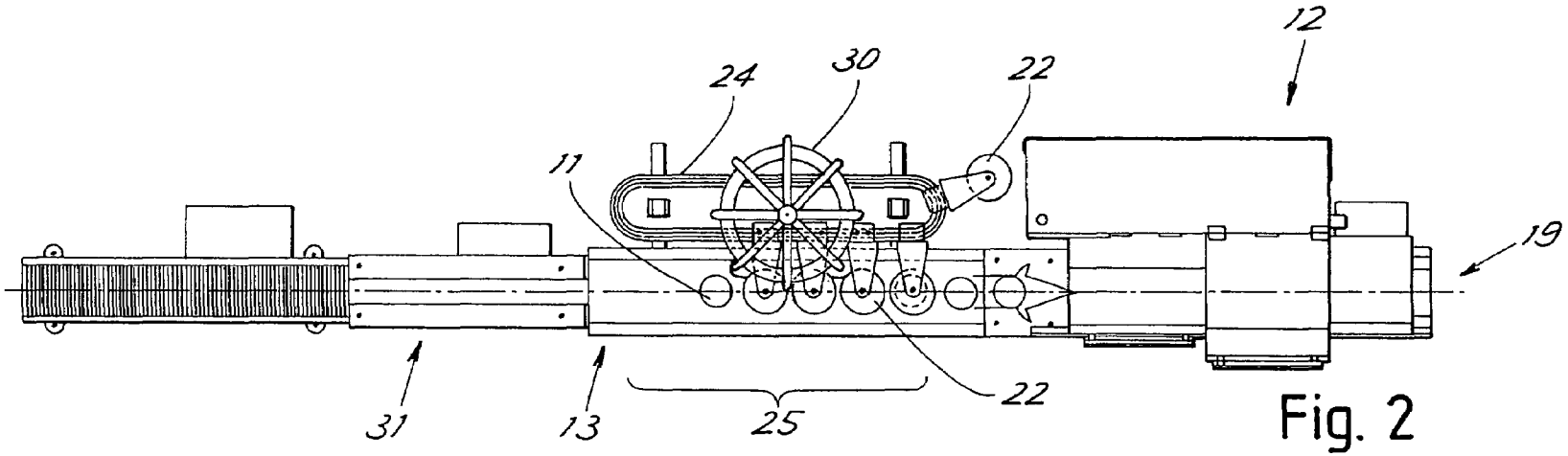
FIG. 2 represents a plan view of the plant of FIG. 1.
Figure 3:
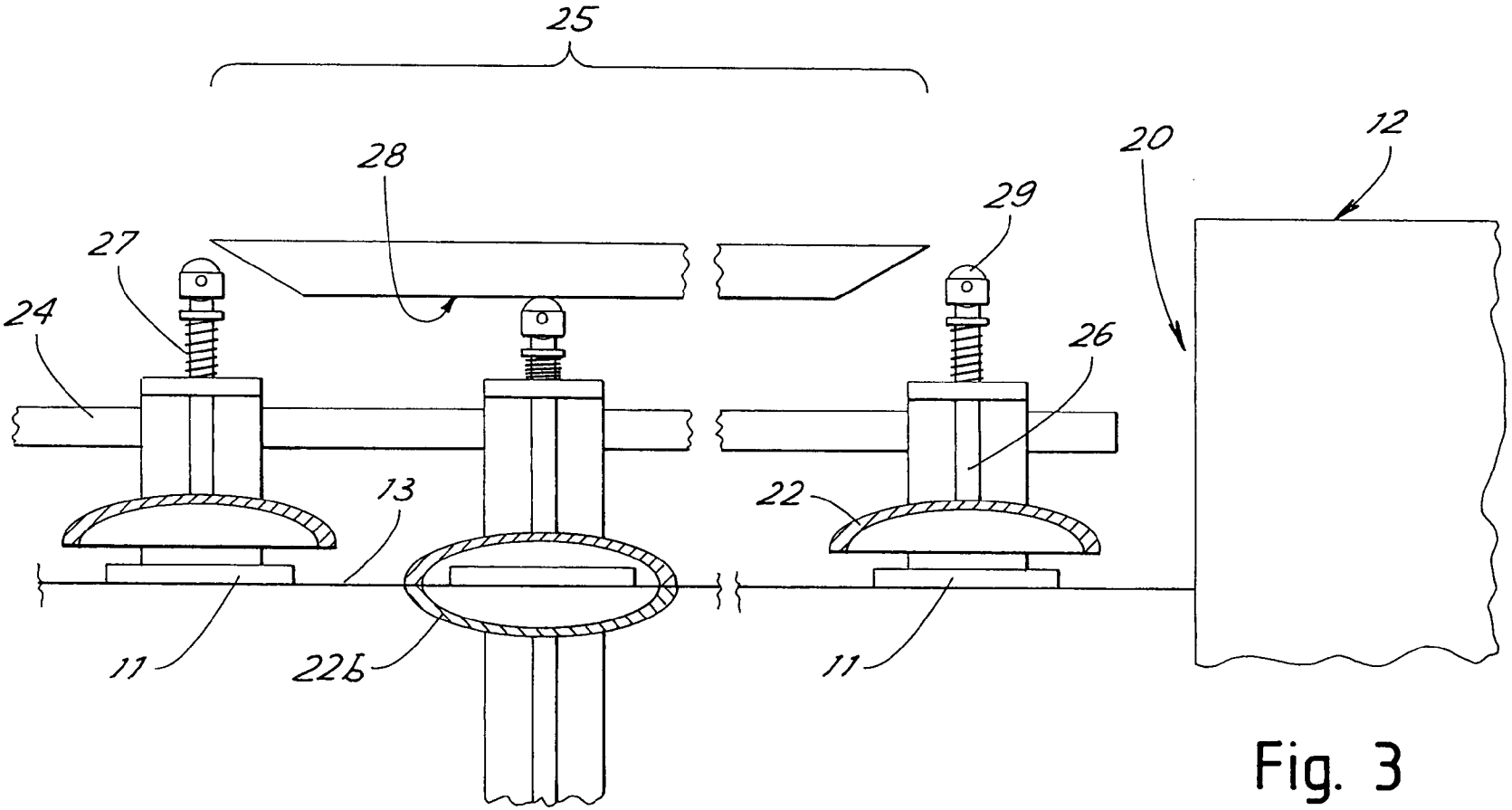
FIG. 3 represents a side elevation of a schematic view, partially cutaway of a vacuum device of the plant of FIG. 1.

As can be seen very well also in FIG. 2 and, in greater detail, in FIG. 3, the movement means with which the vacuum device 21 is equipped comprise a carousel 24 that carries the bells along a closed section that comprises the transport section 25 of the conveyor. The movement means also comprise means for the controlled lowering of the bell on the conveyor along section 25.

As can be seen well in FIG. 3, the lowering means are advantageously made by means of a support 26 that holds the bell on the carousel and which slides vertically against the action of a spring 27 holding the bell in a raised position. Along the section 25 there are actuating means that push the bell towards the conveyor against the action of the spring. In the simplest form, the actuator means are represented by a yoke 28 that acts on a little wheel 29 placed at the upper end of the support 26.

The suction and gas input means, in the form of suitable pumps, valves and gas sources, can be supported on the same movement carousel as the bells, so that they can be substantially stationary with the bells. Provision can be made for a pump and a gas source for each bell, as can be seen in FIG. 1, advantageously supported in the corresponding lower part of the carousel. A known rotating distributor 30 distributes electricity to the pumps that move in the carousel.

The bell, its suction and gas input means and the movement support of the bell thus form a modular unit, repeated for each bell to be used.

As can be seen schematically in FIG. 3 (for simplicity only one bell 22 is shown in the Figure), each bell 22 can advantageously correspond to a counter-bell 22*b* on the other face of the transport surface of the belt of the conveyor 13 so as to keep the pressure on the two sides of the belt balanced, to avoid stretching and deformation of the belt itself. Each counter-bell can be made with a mobile suction group similar to that of the bell 22 (or share with it parts of its mobile suction group) and be transported as well by the carousel 24 or by a similar carousel. If necessary because of a particular lower structure of the conveyor, the counter-bells can be brought closer and further away from the belt with a system that can be similar to that already described for the bells. The return branch of the belt will be held sufficiently low to enable the passage of the counter-bells.

The movements of the bells and of the counter-bells will be synchronized so that when a bell lowers onto the belt to create the required vacuum around a product, the corresponding counter-bell creates a corresponding vacuum on the other face of the belt.

At this point it is clear as to how the preset-aims are achieved. Each product that arrives at the plant, is submitted, without stopping it, to vacuum that sucks the air from inside it, then it is moved into a continuous packing machine that packs it in modified atmosphere. The product can also be permeated with gas to reduce to minimum levels the return of air into it before packing. It has been found that with a plant and a device according to the invention, the packing speed remains that of the continuous packing machines (for example more than 100 products per minute) with a preservation life of the packed product which basically equals that obtainable with the slow discontinuous closed chamber packing machines with vacuum. Thanks to the movement of the bell along a product transport section it is possible to submit a product to a vacuum and to the input of gas for a relatively high time even if the product is moving at high speed. To obtain longer vacuum and gas input times it is sufficient to conveniently lengthen the section 25 of the plant, without any need to reduce the feeding speed of the products. Naturally, the description made above of an embodiment applying the innovative principles of the present invention is given as an example of said innovative principles and therefore must not be taken as limitative of the patent right sphere herein claimed. For example, the bell will be conformed with chamber suitable for the particular shape of the products treated, advantageously to minimize the extra space in it when it encloses the product, so as to reduce the volume of air to be sucked out and to accelerate the formation of the required vacuum.

The invention claimed is:

1. A plant for continuous packing of food products in modified atmosphere, comprising a machine for continuous packing in a modified atmosphere of the food products and a conveyor for continuous sequential feeding of the food products to the machine, wherein before an entrance of the machine, along a transport section of the conveyor near the entrance of the machine, means are present that temporarily submit the food products continuously fed by the conveyor to vacuum before the food products are packed in modified atmosphere in the machine, wherein a suitable inert gas constitutes the modified atmosphere, characterized in that said means comprise at least a bell connected to means for the suction of air from inside the bell, the bell being supported by movement means for the bell's synchronous movement along the transport section of the conveyor near the entrance of the machine to enclose in said section one of the food products under the bell and submit said one of the food products to said vacuum; and characterized in that, on the transport section of the conveyor, the food products, after being subject to vacuum in the bell, are subject to normal atmosphere before the food products are packed in the modified atmosphere in the machine.

2. The plant according to claim 1, characterized in that the movement means comprise a carousel transporting the bell along a closed section that comprises said transport section of the conveyor and means of controlled lowering of the bell onto the conveyor.

3. The plant according to claim 2, characterized in that the suction and input means are supported by the carousel to be moved together with the bell.

4. The plant according to claim 2, characterized in that the controlled lowering means comprise a support of the bell that can be vertically lowered against the action of the elastic means keeping the bell in a raised position and actuator means positioned along said transport section to push the bell towards the conveyor against the action of said elastic means.

5. The plant according to claim 4, characterized in that the actuator means comprise a lowering cam yoke of said support of the bell.

6. The plant according to claim 1, characterized in that it comprises a plurality of bells to act simultaneously on several products moved sequentially along said transport section.

7. The plant according to claim 1, characterized in that the continuous packing machine in modified atmosphere is the type comprising a roll of plastic film and means that unroll, conform into a tube and weld the film to create packs sequentially around products fed to it.

8. A device for temporarily submitting in sequence food products that flow sequentially on a continuous conveyor to vacuum and to a modified atmosphere, wherein a suitable inert gas constitutes the modified atmosphere, said device comprising at least a bell connected to means for the suction of air from inside the bell and means for the input of modified atmosphere into the bell, the bell being supported by movement means for the bell's synchronous movement along a transport section of the conveyor to enclose one of the food products under it in said section and submit said one of the food products to said vacuum and to said modified atmosphere, and characterized in that, on the transport section of the conveyor, the food products, after being subject to vacuum in the bell, are subject to normal atmosphere before the food products are packed in the modified atmosphere.

9. The device according to claim 8, characterized in that the movement means comprise a carousel for transporting the bell along a closed section that comprises said transport section of the conveyor and means for controlled lowering of the bell onto the conveyor.

10. The device according to claim 9, characterized in that the suction and input means are supported by the carousel to be moved together with the bell.

11. The device according to claim 10, characterized in that the suction and input means comprise a pump for each bell.

12. The device according to claim 8, characterized in that the controlled lowering means comprise a support of the bell that can be lowered vertically against the action of the elastic means for keeping the bell in a raised position and actuator means placed along said transport section to push the bell towards the conveyor against the action of said elastic means.

13. The device according to claim 12, characterized in that the actuator means comprise a cam yoke for lowering said support of the bell.

14. The device according to claim 8, characterized in that it comprises a plurality of bells to act simultaneously on several products moved sequentially along said transport section.

15. The device according to claim 8, characterized in that it comprises counter-bells connected to means for suction of air from inside them and which are mobile, to be positioned in front of the bells and in contact with the other face of the transport surface of the conveyor, in the sense that vacuum is created that balances the action of vacuum of the bells on the conveyor.

16. A plant for continuous packing of food products in modified atmosphere, comprising a machine for continuous packing in a modified atmosphere of the food products and a conveyor for continuous sequential feeding of the food products to the machine, wherein before an entrance of the machine, along a transport section of the conveyor near the entrance of the machine, means are present that temporarily submit the food products continuously fed by the conveyor sequentially to vacuum and a modified atmosphere before the food products are packed in modified atmosphere in the machine, wherein a suitable inert gas constitutes the modified atmosphere, characterized in that said means comprise at least a bell connected to means for the suction of air from inside the bell and for the input of modified atmosphere, the bell being supported by movement means for the bell's synchronous movement along the transport section of the conveyor near the entrance of the machine to enclose in said section one of the food products under the bell and submit said one of the food products to said vacuum and to said modified atmosphere, and characterized in that, on the transport section of the conveyor, the food products, after being subject to vacuum and modified atmosphere in the bell, are subject to normal atmosphere before the food products are packed in the modified atmosphere in the machine.

* * * * *